US011419402B2

(12) United States Patent
Fontana

(10) Patent No.: US 11,419,402 B2
(45) Date of Patent: Aug. 23, 2022

(54) DEVICE FOR HAIR WASHING

(71) Applicant: Semplice-Mente S.r.l.s, Lecce (IT)

(72) Inventor: Giorgio Fontana, Lecce (IT)

(73) Assignee: Semplice-Mente S.r.l.s., Lecce (IT)

( * ) Notice: Subject to any disclaimer, the term of this patent is extended or adjusted under 35 U.S.C. 154(b) by 0 days.

(21) Appl. No.: 17/334,729

(22) Filed: May 29, 2021

(65) Prior Publication Data

US 2021/0378378 A1 Dec. 9, 2021

(51) Int. Cl.
*A45D 19/14* (2006.01)
*A45D 19/00* (2006.01)
*A45D 19/04* (2006.01)

(52) U.S. Cl.
CPC ..... *A45D 19/14* (2013.01); *A45D 19/005* (2021.01); *A45D 19/04* (2013.01)

(58) Field of Classification Search
CPC ..... A45D 19/14; A45D 19/005; A45D 19/04
USPC ..... 4/515
See application file for complete search history.

(56) References Cited

U.S. PATENT DOCUMENTS 5,906,012 A * 5/1999 Sakane ..... A45D 19/14 4/518
6,233,755 B1 * 5/2001 Shimizu ..... A45D 19/14 4/523
6,291,051 B1 * 9/2001 Shimizu ..... A45D 19/14 428/131
2007/0022525 A1 * 2/2007 Nakao ..... A45D 19/14 4/515
2019/0159567 A1 * 5/2019 Maletti ..... A45D 19/10

* cited by examiner

*Primary Examiner* — Huyen D Le
(74) *Attorney, Agent, or Firm* — R. Ruschena Patent Agent, LLC

(57) ABSTRACT

A device for head and hair washing of a user carried out by a care operator, where the operator being the same user or not, comprising: a lower bath; a cover, water feeding means, comprising at least a pipe connectable to a water source; water delivering means; water delivering adjusting means, positioned inside the volume created by the cover overlapping the lower bath, and configured so that water delivering adjusting is allowed; water discharge means, associated to the lower bath, comprising a discharge pipe connected to a hole positioned in the lower portion of said bath; the cover has three openings, two of them are arranged on opposite portions to the frontal opening and are provided in the frontal portion of the cover and the third openings is positioned in the rear or upper portion of the opening.

15 Claims, 9 Drawing Sheets

DEVICE FOR HAIR WASHING

BACKGROUND OF THE INVENTION

1. Field of the Invention

The present Patent Application relates to a head and hair washing device configured to allow sitting and bedridden people's hair to be washed, autonomously and/or by a care operator, and, in particular, to allow the autonomous or assisted hair washing of sitting people (for example on a wheelchair) and the autonomous or assisted hair washing of bedridden people (by only one care operator), without needing them to get up from the bed or to move the bed.

2. Brief Description of the Prior Art

It is known the need to wash head and hair of people with a disability or with temporary or permanent limited mobility, in a plurality of public and private contexts, as for example hospitals, nursing homes, retiring homes; this need arises also in familiar contexts, where disabled people are assisted at home, or partial disabled people can do part of their activity autonomously.

In all these cases, there is the need to make the hair washing easier by optimizing the time needed, the number of care operators involved and, as a consequence, by reducing complexity and costs of the head and hair care process. Much more important is the fact that by facilitating people washing, it is possible to increase washing quality and frequency, thus improving clearly life conditions of the people involved, including care operators.

On the other hand, people with no limited mobility can have also the need to wash one's or someone else's hair without running water, without basin or when it is uncomfortable to bend oneself in this one. This occurs for example in bathrooms with small basins, in camping or in case of home hairdressing.

In view of the just described technical problems, in health field it was observed that at the state of the art, health care operators encounter major practical difficulties in head and hair washing to disabled patients or patients with limited mobility, in particular to bedridden ones.

In fact, the whole washing process (shower) of bedridden patients requires at least two health care operators in order to make the patient get up from the bed, to make him sit on a wheelchair, and to bring him in showers provided with "lifters", to undress him and "to position" him on the same lifters, in order to go on with the washing (or, alternatively to move the patient on a so called "commode chair"). This process, in addition to be uncomfortable for conscient patients, requires very much energy and time to health care operators, and causes them to be soaked.

At the state of the art, there are known products which transform the bed in a bath and allow the whole body (hair included) to be washed, but such products require a lot of time to provide each washing, they are very expensive and do not guarantee the complete elimination of detergents from the patient body.

Bedridden patients body care can be carried out with alternative products (wipes, soapy sponges, etc.), while, at the state of the art, bedridden patients hair care can be carried out only in two ways: "dry" shampoo hair washing (with no optimal results, above all for long stay in hospital and so repeated washing needs), or hair washing without making the patient get up from the bed, but making him to take an uncomfortable position and working with extreme difficulties, needing two health care operators and with very high probability to wet patient cloths, the same health care operators and bed.

There are also known, at the state of the art, devices configured to optimize head washing by limiting water splashing or to carry out other hair treatments (one of these devices is described, as a way of pure example, in EP3488728), but they are neither configured to allow the washing of a bedridden person, whose bed is not arranged in the centre of the room but has one or more sides against a wall, nor to allow a person on a wheelchair to wash oneself autonomously.

Document JP2004016582 describes a device for head and hair washing of a user, necessarily carried out by someone being not the user (i.e., it does not allow an autonomous washing). Such device comprises two overlapping reservoirs, which are provided with a frontal opening to allow the user neck to rest thereon, means for discharging the water used for the head washing and openings directed rearwards for the introduction of the care operator's hands.

This device too, in the various embodiments described, is limited, since it does not allow a user to wash oneself autonomously, it is provided with water feeding and adjusting means not positioned inside the volume used for head washing, and, moreover, it does not allow the care operator to have hands completely free to carry out the washing efficiently.

SUMMARY OF THE INVENTION

Therefore, aim of the present invention is to overcome the disadvantages of current head and hair washing devices.

In particular, aim of the present invention is to provide a device which allows to carry out head and hair washing for sitting and bedridden people, autonomously or by a care operator, in any place, without needing to undress them and without soaking people and the surrounding place.

Yet, the present invention provides a device for head and hair washing which allows a bedridden user to be washed by only one care operator and without needing to move the bed, even in cases in which the headboard and/or one or more sides of the bed is against a wall.

According to another aim, the present invention provides a device for head and hair washing which allows users to wash oneself completely autonomously, whether they are on wheelchair or bedridden but able to move arms, or with no limited mobility and want to wash one's hair fast, without needing to undress oneself, without wetting the surrounding place, without assuming uncomfortable positions and being able to control the water feeding and adjusting means without taking out hands from the volume used for head washing.

The present invention realizes the prefixed aims since it is a device (1) for head and hair washing of a user carried out by a care operator, said operator being the same user or not, comprising: a lower reservoir (10); a cover (11), which can overlap said lower reservoir (10); said lower reservoir (10) and said cover (11) being provided with respective frontal openings (104, 114), configured to allow said user neck to rest thereon and being configured so that they contain, inside the volume created by said cover (11) overlapping said lower reservoir (10), the user head upper and rear portion, leaving the face free; water feeding means (13), comprising at least a pipe connectable to a water source; water delivering means (115); water delivering adjusting means (116), positioned inside the volume created by said cover (11) overlapping said lower reservoir (10), and configured so that water delivering adjusting is allowed; water discharge means (14), associated to said lower reservoir (10), comprising a discharge pipe connected to a hole positioned in the lower portion of said reservoir (10), characterized in that said cover (11) comprises at least three openings (111, 112, 113), each configured to allow the introduction of at least a hand of said care operator inside said volume created by said cover (11) overlapping said lower reservoir (10), said openings being arranged so that it is allowed either the introduction of at least a hand of said user, or of someone not being said user and positioned laterally to said user, or of someone not being said user and positioned at the rear of said user, in that two (111, 112) of said at least three openings (111, 112, 113) provided on said cover (11) are arranged on opposite portions to said frontal opening (114) and are provided in the frontal portion of said cover (11) and in that the third one (113) of said at least three openings (111, 112, 113) is positioned in the rear or upper portion of said cover (11).

DETAILED DESCRIPTION OF THE INVENTION

Figure 1:
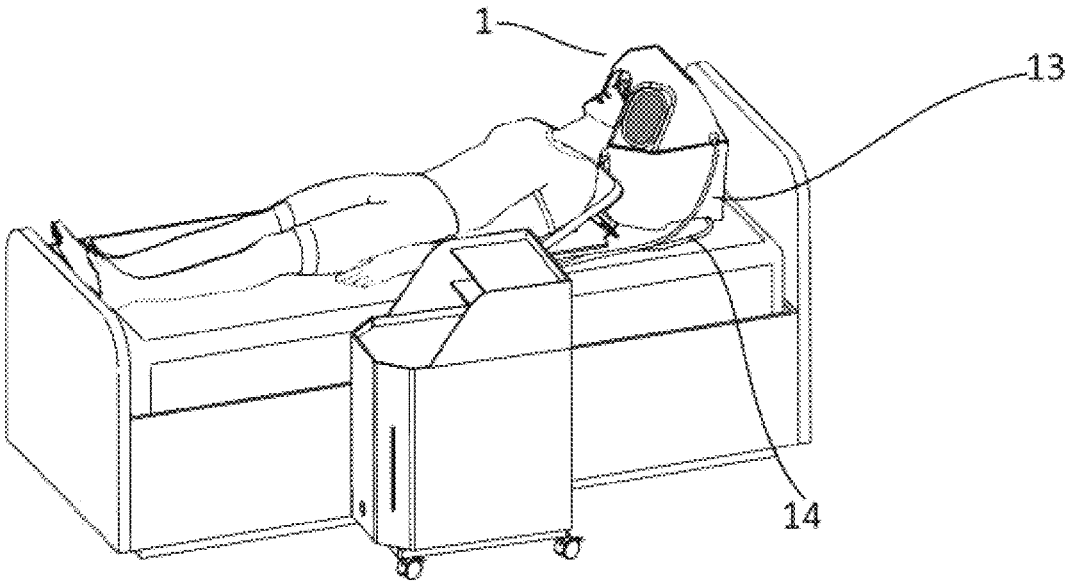
FIG. 1 shows a complete view of a bedridden user and the device according to the invention.
Figure 2:
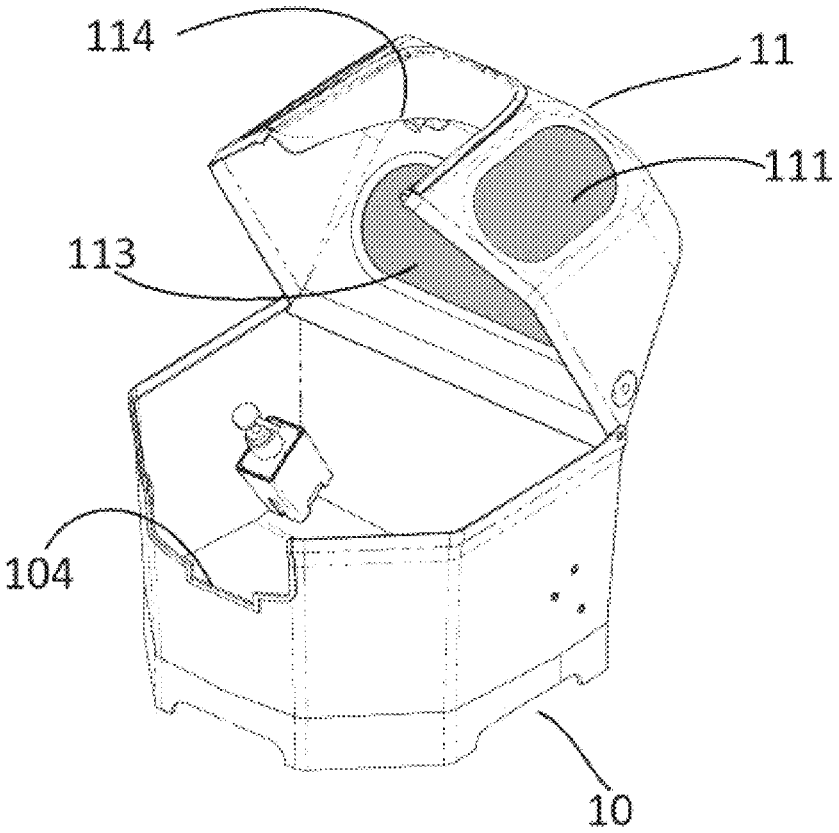
FIGS. 2, 3, and 4 show some views of the device with the upper cover lifted with respect to the lower reservoir.
Figure 3:
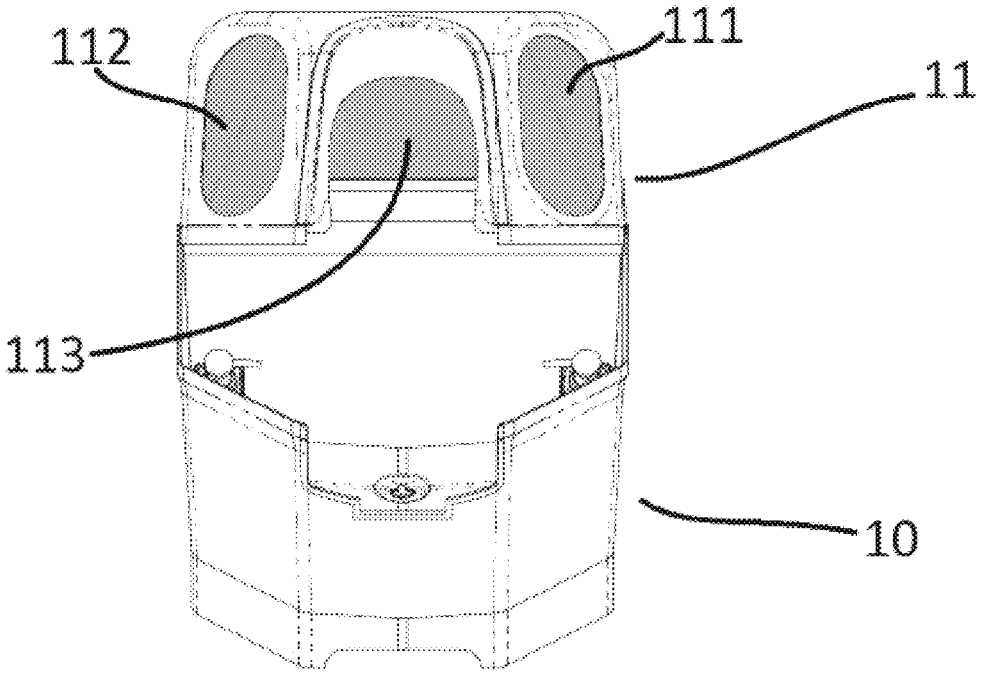
Figure 4:
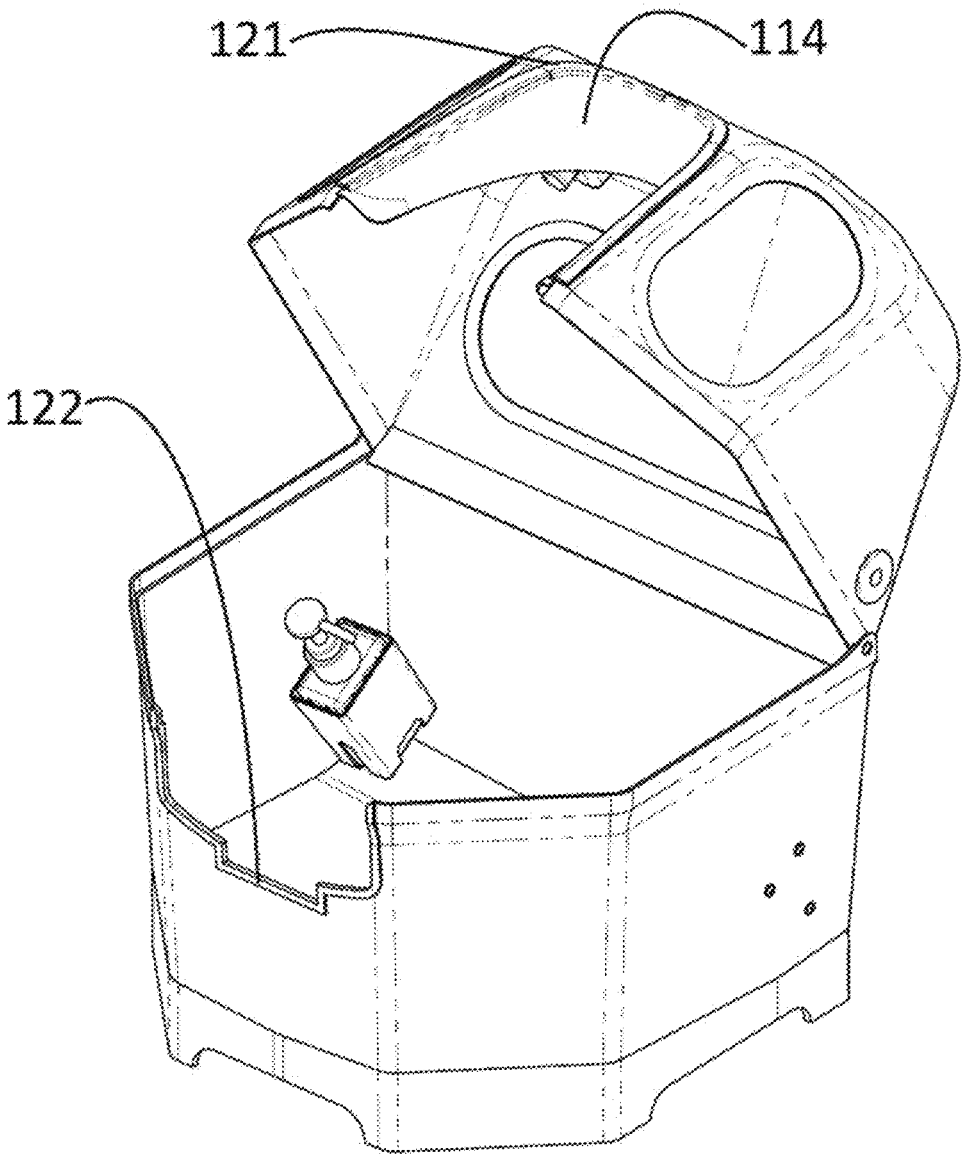
Figure 5:
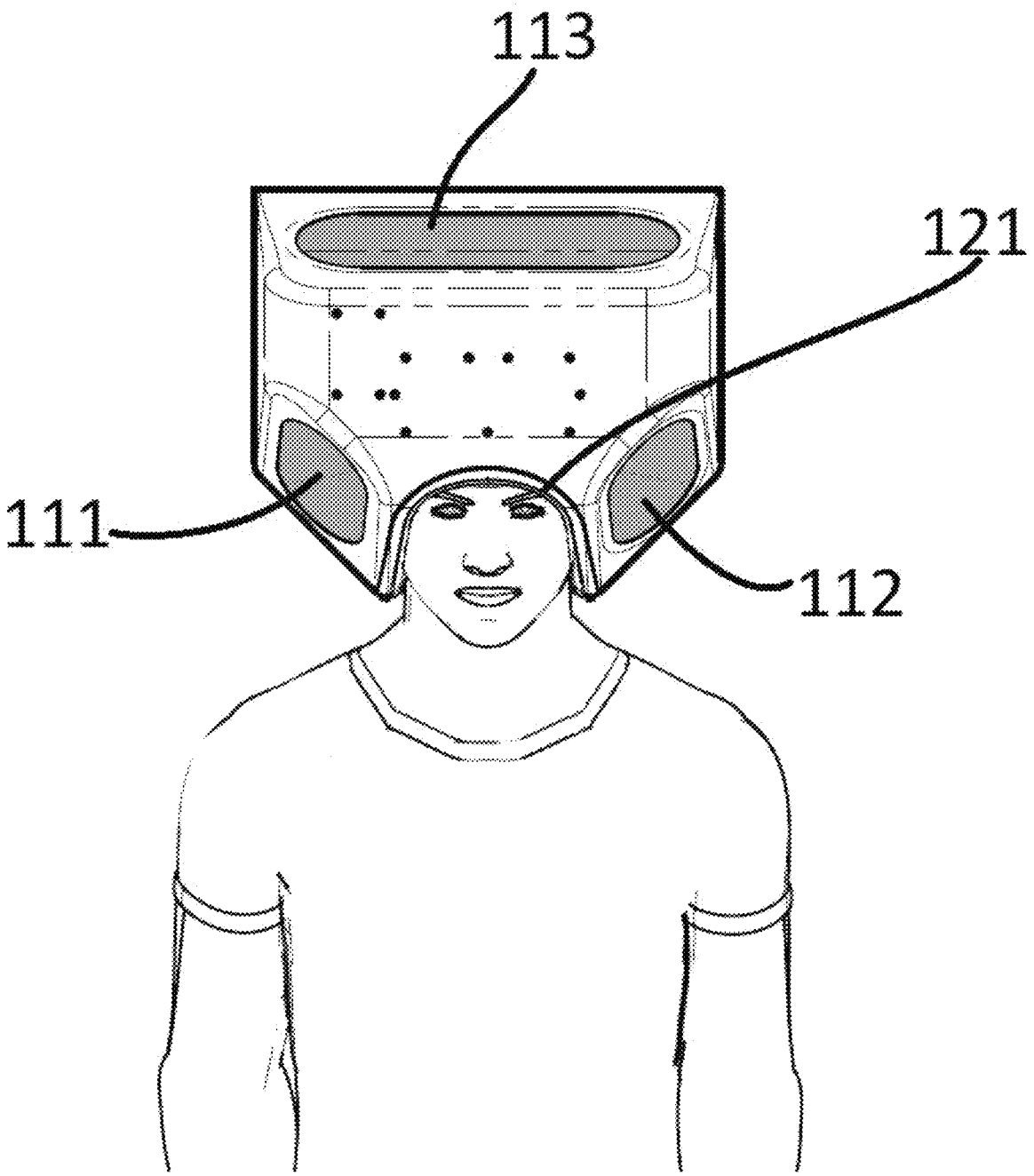
FIGS. 5 and 6 show two views of a user with the head resting inside the device.
Figure 6:
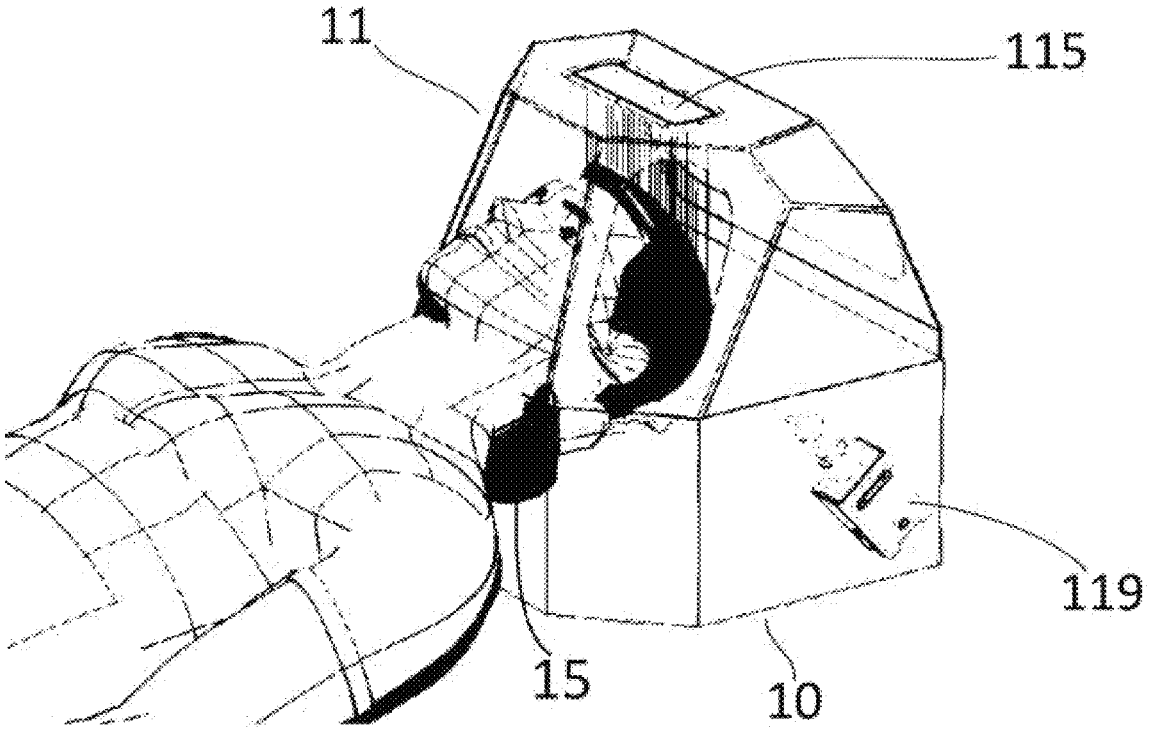
Figure 7:
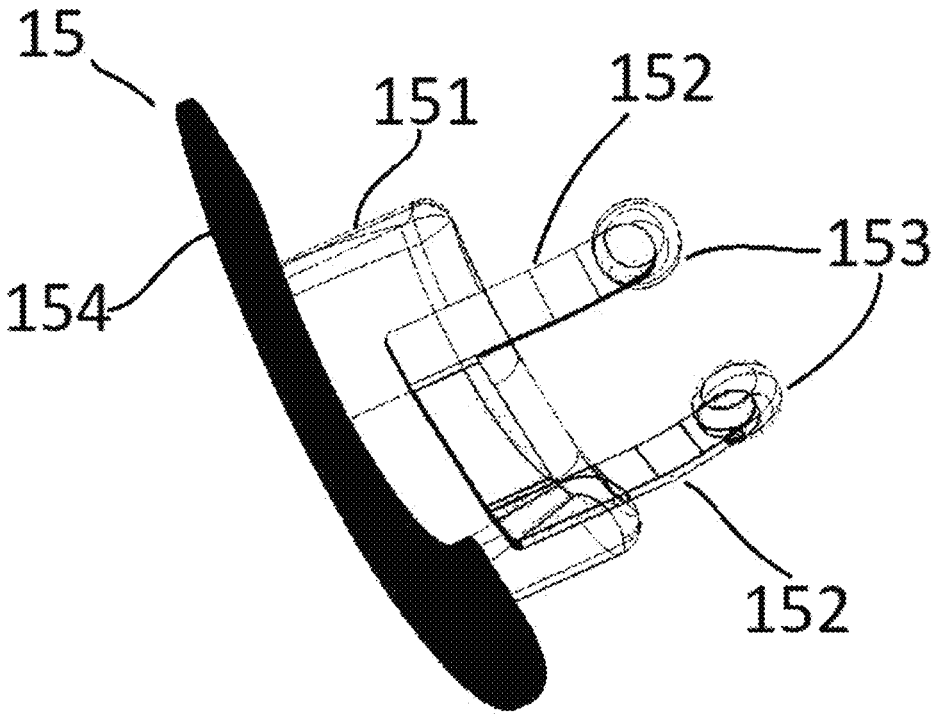
FIGS. 7 and 8 show detail images of the head support.
Figure 8:
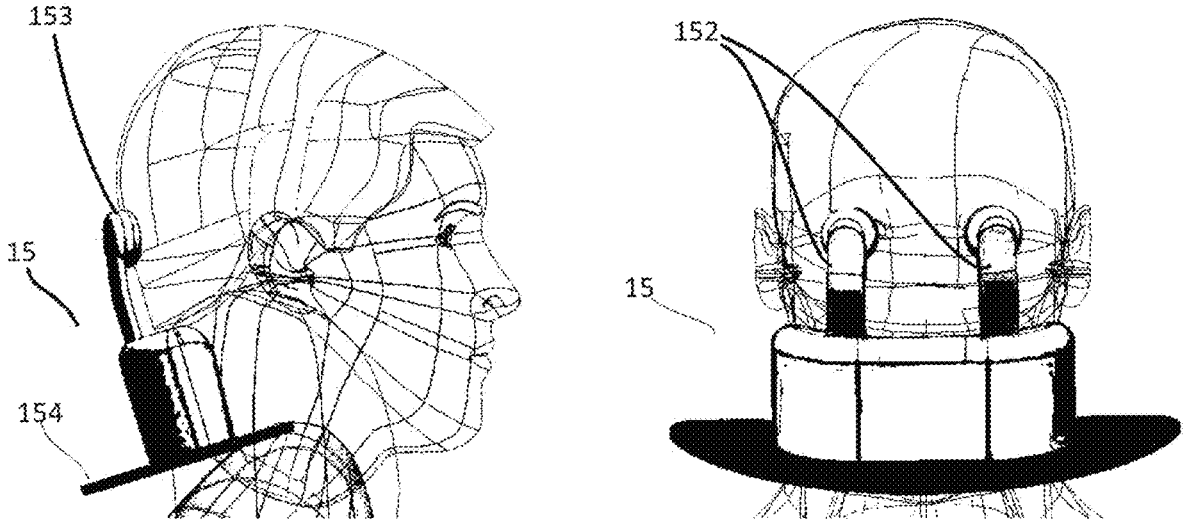

It is now described a preferred, but not limiting, embodiment, of the device according to the invention.

It is to be said firstly that, as referred herein the user is the person to whom head and hair are washed, and the care operator is the person who carries out the head and hair washing.

User and care operator can coincide (i.e., can be the same person) when the washing is carried out autonomously; alternatively, user and care operator can be two different persons.

The device (1) comprises a lower reservoir (10) and a cover (11), which can overlap the lower reservoir (10).

Preferably, the lower reservoir (10) and the cover (11) are provided with removable coupling means, so that they can be made integral during the washing and to allow then the cover (11) to be disassembled from the lower reservoir (10).

Possibly, the coupling means of the reservoir (10) to the cover (11) can be of not removable type, thus allowing the upper cover (11) to be moved with respect to the lower reservoir (10) without allowing it to be disassembled.

The lower reservoir (10) and the cover (11) are provided with respective frontal openings (104, 114) configured to allow a person neck to rest thereon and to contain the head upper and rear portion inside the volume created by the cover (11) overlapping the lower reservoir (10), thus leaving the face free.

Preferably, said openings (104, 114) are U-shaped openings, positioned so that they are opposite to each other when the cover (11) is mounted on the lower reservoir (10).

Ultimately, the frontal opening for head access leaves eyes, nose, mouth and a portion of the forehead free, so that, for example, people with breathing aid devices can be washed without difficulties.

Preferably, moreover, at said openings (104, 114) soft and possibly removable seal elements (121, 122) are provided in order to seal the opening with respect to the user head, to make the contact between the same and the device softer and to allow also the reservoir to be used by different users, substituting, and in the following sanitizing, the seals.

Said lower reservoir (10) and said cover (11):

- have a shape and an inner volume guaranteeing the full mobility of hands around the head, from all sides;
- are provided with profiles/contact edges suitably shaped and overlapping, in order to guarantee the water to be contained inside the case formed by reservoir (10) and cover (11), the edge of the cover (11) being inner with respect the lower reservoir (10) one.

The shape and dimensions of the lower reservoir (10) and cover (11) guarantee a full hands mobility around the head from all sides, both when the hands are of the user washing oneself autonomously, and when the hands are of a care operator.

The device (1) comprises also water feeding means (13), comprising at last a pipe connectable to a water source (such, for example, a tank provided with delivery pump or running water tap).

Said water feeding means (13) are preferably associated to said cover (11).

Said cover (11) comprises in fact water delivery means (115). Said water delivery means can comprise a "rain" shower head, integrally fastened, in the inner side, to the upper portion of said cover (11) and configured to deliver water on the user hair. Preferably, moreover, said delivery means comprise a mobile head shower, connected to a flexible pipe.

The device comprises also water delivery adjusting means (116) positioned inside the same device and configured to allow the water delivery to be actuated/deactivated.

It is clear, from the analysis of FIG. 1, that the water feeding pipe (13) is engaged on the cover (11) at a suitable hole and that the water delivery means, such as the head shower (115) integral to the cover, are connected to the cover (11) by means of suitable pipe fittings not shown in figures and know per se at the state of the art.

Moreover, said water delivery adjusting means (116) positioned inside the device are preferably positioned inside the volume enclosed by the reservoir (10) and cover (11), this allowing to adjust the water delivery without taking out the hands from the same volume.

This guarantees that there is no need to turn on and off one or more water delivery or adjusting means by means of the openings (111, 112, 113), useful for the introduction of hands, since these means are already inside the volume enclosed by the reservoir (10) and cover (11).

Moreover, this guarantees that the same hands are completely free, having not to hold pipes or water delivery means and so being able to work on head and hair more efficiently.

According to a preferred embodiment, said adjusting means comprise a tap, of the type known per se at the state of the art. In another embodiment, said adjusting means comprise a turning on/adjusting device of a pump positioned on the delivery pipe of said water feeding means.

The lower reservoir (10) comprises also water discharging means (14) comprising a discharge pipe connected to a hole, positioned in the lower portion of the lower reservoir (10), configured to allow the water, contained in the lower reservoir (10), to fall by gravity. Preferably, the water discharge is protected by a filter.

In an embodiment, the water discharge means comprise a pump configured to suck from the bottom of the lower reservoir (10) and to discharge water through the discharge pipe.

What is peculiar to the device according to the invention is that the cover (11) comprises at least three openings (111, 112, 113) configured to allow the introduction of the hands of the person carrying out the washing inside the volume enclosed by the lower reservoir (10) and cover (11), and said openings are arranged so that it is allowed either the introduction of the hands of the user, i.e. the person who is washing one's hair autonomously (i.e. the person who is washing oneself by oneself, with no help by a care operator), or the introduction of the hands of a care operator positioned laterally or at the rear of the same user.

This particular arrangement of the openings, described in detail in the following, allows both to make it possible an autonomous washing (without care operator), and to allow a bedridden patient to be washed by a care operator, even when the bed is positioned next to a wall or with the headboard against a wall. In order to allow what above described, two of said openings (111, 112), provided on said cover (11) are arranged on opposite portions with respect to the position of user head, are provided on the front portion of the same cover and are such dimensioned that each one allows the introduction of one hand. The third opening (113) is instead positioned in the rear portion or in the upper portion of the cover, symmetrically to the symmetrical axis of the device and is so dimensioned to allow the introduction of two hands.

It is to be specified that, as it is clear from the drawings, for "frontal" portion or "front" portion it is intended the portion of the case made up of the reservoir (10) and the cover (11) overlapping each other, which, when the device is used, faces the user, object of the head and hair washing. For rear portion it is intended the opposite portion to the frontal one.

In a preferred embodiment, said cover (11), in top view, is provided with a front portion with three sides: a central side on which there is provided the opening (114) for the user head, and two sides, symmetrical to a symmetrical axis orthogonal to said central side, inclined with respect to the same at an angle between 30° and 60°, on which there are provided the openings (111, 112) for the introduction of the user hands.

In a second embodiment, said cover (11), in top view, is provided with a front portion with a frontal side on which there are provided both the opening (114) for the user head and said openings (111, 112) for the introduction of the user hands.

In another embodiment, said cover (11) has a circular or elliptic top view, and said openings (111, 112) are realized in the front portion, from opposite portions to said opening (114) for the user head.

With this arrangement of said openings, it is clear that:

(i) the user can use the two frontal openings (111, 112);

(ii) the care operator at his rear can use with both hands the opening (113) positioned in the rear portion (or in the upper portion) of said cover (11);

(iii) the care operator, positioned laterally to the user, can use one of the two frontal openings (111, 112) and the opening (113) positioned in the rear or upper portion of the cover (11).

Conveniently, each of said openings (111, 112, 113) is provided with a protection membrane, in rubber, silicone or other suitable material. On said protection membrane it is provided a notch, or slotted hole, which allows the introduction of the hand and allows the membrane to adhere to the user wrist/forearm, so that splashing outside the device is avoided.

Conveniently, said notch or slotted holes provided in the membranes arranged for protection of the openings (111, 112, 113) are such shaped that it is possible to reach a greater operational area inside the device with respect to the state of the art ones, without losing the advantages linked to the protection from splashing.

Conveniently, the protection membrane of the two frontal openings (111, 112) are provided with slotted holes, with an elongated shape from up downwards, in order to reach, with the hands, the whole area comprised between the back of the neck and the upper portion of the head. For elongated shape from up downwards it is intended that the extension of the slotted hole in vertical direction is greater than the extension in horizontal direction.

The axis of the slotted hole is preferably inclined to the vertical, in order to increase the reachable area by the user hands when washing oneself autonomously; the provision of an slotted hole with axis slightly inclined to the vertical (i.e. with an inclination preferably lower than 45° to the vertical) allows to slide the user wrists, thus making him reach entire area of one's head without introducing the forearm inside the device.

Instead, the central opening (113), positioned in the rear or upper portion of the device, is protected by a membrane provided with an slotted hole with an elongated shape in cross direction with respect to the axis of the device (i.e. from right to left) to allow the care operator hands to reach both the sides of the user head.

In this way, the openings allow the care operator not to bend the bust to reach the farthest points of the device and not to introduce a portion of the forearm to reach the various areas of the user head.

This shape of the openings and holes provided in the protection membranes is preferable to using circular openings with which, since the wrist cannot slide, a person is forced to introduce part of the forearm inside the device to reach the farthest portions of the head.

This allows to have soft, and waterproof hands passage points. At the same time, these hands passage points adhere to wrists, in order not to splash water outside the case. This flexible adherence guarantees also that water does not drop outside when retracting hands from the case (thanks to the slight sliding of the hands on the slotted holes edges).

Preferably, the lower base of the lower bath (10) is inclined in order to facilitate the water sliding towards a hole connected to the discharge pipe. Preferably, the lower reservoir (10) comprises in the frontal portion, at the opening for the introduction of the head, an insert (15) comprising a cushion (151) for user neck resting and a seal (154) with respect to the edge of the front reservoir.

According to an embodiment, the cushion (151) can be integral (i.e. integrated) to the lower reservoir (10).

Integral to said cushion, but arranged so that they do not come in contact with the patient head, there are provided two stiff arms (152), each provided, at ends, with a support (153) in soft material such as for example, but not limitingly, rubber or silicone.

The shape of the stiff arms is such that when the patient head rests on said soft cushion (151) and said supports (153), there remains sufficient place between the patient head and said arms for the introduction of a hand.

In this way, it is reduced the portion of skin not directly washable, and at the same time, it is guaranteed an efficient support in order that people being washed do not have to force the neck muscles. This is particularly useful in case of unconscious patients.

Moreover, the device (1) comprises preferably inside the volume enclosed by the lower reservoir and cover, at least a shampoo dispenser and/or a conditioner dispenser (119) or a dispenser of other similar products, integral to the same device or removably fastened thereto.

In this way, it is possible to carry out the whole wetting, washing and rinsing cycle without needing that the care operator takes out his hands from the device.

Moreover, on the outer portion of the cover there are preferably positioned fastening means for application of protection shields, for example in plexiglass, not shown in figure, to be arranged on the opening (114) for the introduction of the head in the device.

Preferably, such fastening means allow the removably application of said protection shields, and they can be of magnetic type, restraining type or any other type, known per se at the state of the art.

In this way, it is reached the aim of protecting both the user and the care operator from natural viral infections.

Figure 9:
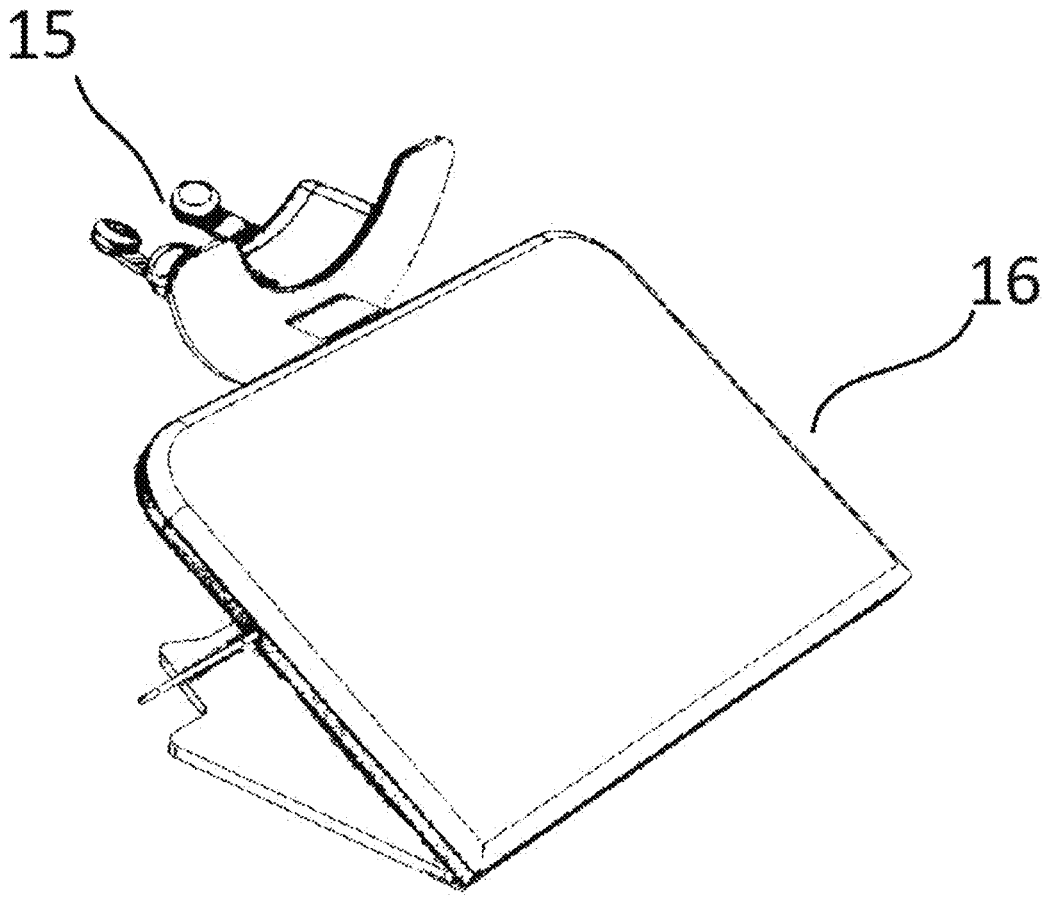
FIG. 9 shows a view of the user bust supporting device, on which the head support device is mounted integrally.

From the device general configuration point of view, the same is such dimensioned that it can rest and be used on a bed, by introducing it under the head of the bedridden person. Preferably, the bust of the bedridden person can be slightly lifted, by introducing an inclined support as the one shown in FIG. 9.

To such aim, conveniently, the device comprises also an outer support (16) with respect to the reservoir, with adjustable inclination, coated in soft, nonallergenic, washable material, and provided with handles to manage height position changes in a better way.

Conveniently, moreover, the base of said support has a shaped rear profile, with a shape complementary to the one of the base of the lower reservoir (10), in order that the correct positioning of the support relative to the lower reservoir is made easier.

In a first embodiment, the device comprises also a portable container (in the following called "trolley" for brevity) containing a first tank which can be filled with clean water, water thrusting means connected to said feeding means, as well as a second tank for dirty water, connected to said water discharge means.

Preferably, the portable container comprises a plurality of tilting wheels at 360°, so that it can be transported without being inclined and without encountering obstacles in the direction changes.

In a first embodiment, said thrusting means comprise a pump, configured to take from said tank and controlled by actuation and adjusting means positioned inside the case formed by lower reservoir (10) and cover (11). In a second embodiment, said thrusting means comprise an air pump, configured so that the tank is brought under light pressure, so that water, thrust by the air pressure acting on the same, can be delivered when the tap positioned inside the case, formed by lower reservoir (10) and cover (11), is open. Conveniently, in this case, the air pump is controlled by a thermostat, which turns on it when the pressure inside the tank, due to delivery, goes under a first predetermined threshold, and turns off it when the pressure reaches, upon air introduction, a second predetermined threshold.

Preferably, but not limitingly, the first tank contains water level signaling means, configured to signal to the care operator when the water level in the tank goes under a predetermined limit threshold.

Preferably, but not limitingly, the second tank contains water level signaling means, configured to signal to the care operator when the water level in the tank exceeds a predetermined threshold.

Preferably, but not limitingly, the first and/or the second tank are configured so that the water level inside them is visible from outside.

The usage of the trolley, containing the just described tanks, allows a simple transportation of the device from a bed to the other one of a hospital, nursing home or retirement home, thus allowing anyway a completely independent use from the availability of a water supply.

Preferably, but not limitingly, moreover said trolley is provided with fastening means for the lower reservoir (10), which are height adjustable. In this way, the trolley allows the device to be used by a person sitting on a normal chair or on a wheelchair, without needing tables, stools or other supports, but by simply adjusting and positioning the device at the right height, behind the chair, and by slightly inclining the head rearwards.

Said fastening means can comprise one or more telescopic rods and/or provided with articulated joints, according to embodiments known per se at the state of the art.

In a preferred, but not limiting embodiment, the telescopic rods can be motorized, so that the user can adjust the reservoir position with no effort.

Preferably, moreover, the whole width of the trolley is such that it is possible to put it in the space of the two rear wheels of a wheelchair. To such aim, said dimensioning is preferably greater than 50 cm and more preferably lower than 45 cm.

Figure 10:
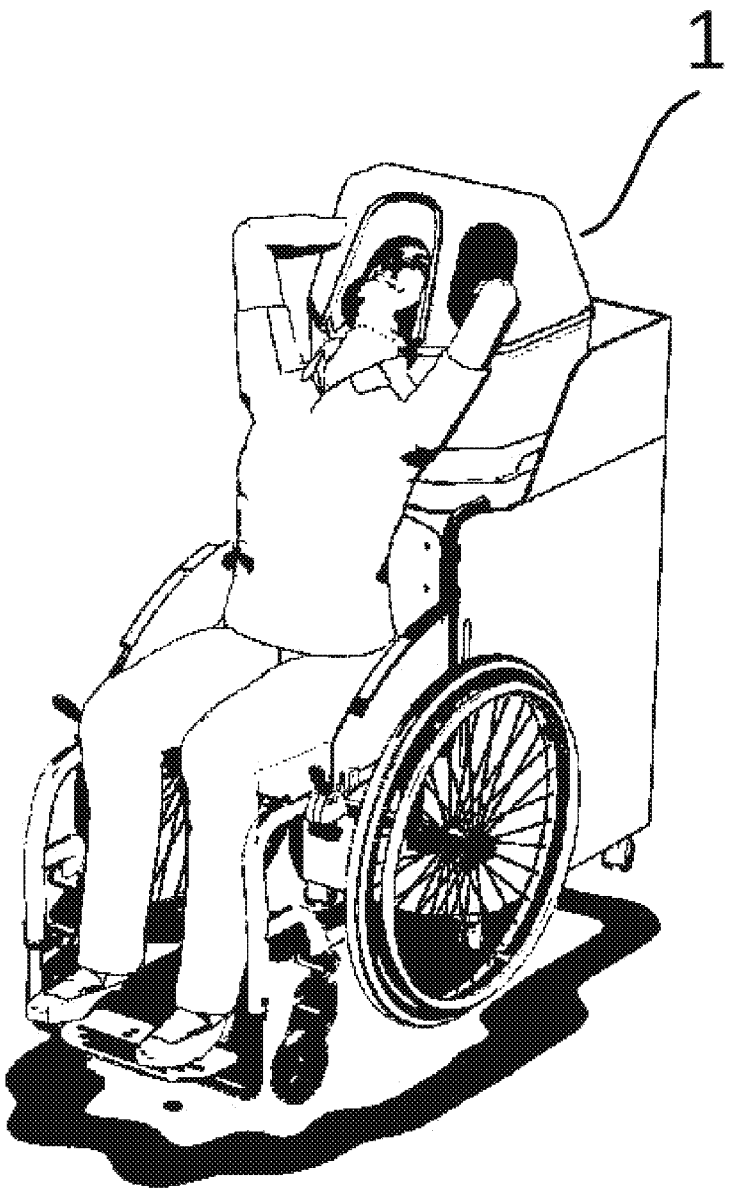
FIG. 10 shows the device being used by a user on wheelchair.
Figure 11:
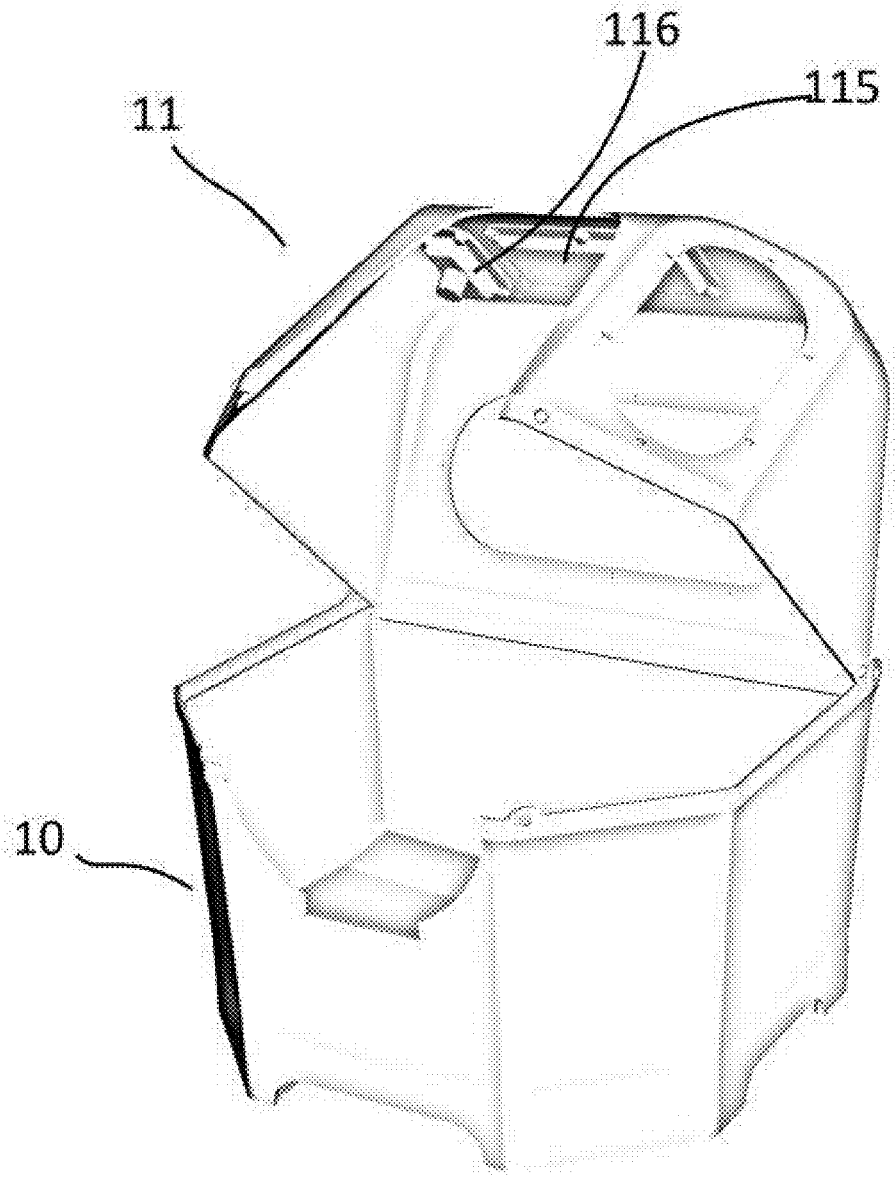
FIG. 11 shows a view of the device, in which the seal arranged on the frontal opening is not shown, in order to highlight the provision of the water feeding adjusting means.

An image showing the usage of the device (1) by a user on a wheelchair is shown in FIG. 10.

In a preferred embodiment, the trolley is configured to contain the two tanks and the water thrusting means in its lower portion. It comprises also a space overlapping the one housing the tanks to receive the lower reservoir (10) and the cover (11), possibly positioned the one inside the other, as well as at least another space, and preferably a plurality of spaces, for storing what is needed for washing (towels, hairdryer, detergents and other). Preferably, moreover, the trolley comprises electrical supplying means for said thrusting means.

In a first embodiment, said supplying means comprise one or more batteries; in a second embodiment, they comprise connection means to the power supply network.

In another embodiment, the device comprises a delivery tank and a discharge one of small dimensions and possibly realized in flexible material, suitably removably fastened to the case formed by reservoir (10) and cover (11), so that, anyway, the same device can be positioned and used on the bed or on any other plane surface (for example, it can rest on a table, a shelf or a telescopic rod).

In another embodiment, the device can connect the water feeding and discharging mans to outer water sources, without needing tanks.

The invention claimed is:

1. A device (1) for head and hair washing of a user carried out by a care operator, said operator being the same user or not, comprising:

a lower reservoir (10);

a cover (11), which can overlap said lower reservoir (10); said lower reservoir (10) and said cover (11) being provided with respective frontal openings (104, 114) configured to allow said user neck to rest thereon and being configured so that they contain, inside the volume created by said cover (11) overlapping said lower reservoir (10), the user head upper and rear portion, leaving the face free;

water feeding means (13), comprising at least a pipe connectable to a water source;

water delivering means (115);

water delivering adjusting means (116), positioned inside the volume created by said cover (11) overlapping said lower reservoir (10), and configured so that water delivering adjusting is allowed;

water discharge means (14), associated to said lower reservoir (10), comprising a discharge pipe connected to a hole positioned in the lower portion of said reservoir (10);

characterized in that said cover (11) comprises at least three openings (111, 112, 113), each configured to allow the introduction of at least a hand of said care operator inside said volume created by said cover (11) overlapping said lower reservoir (10), said openings being arranged so that it is allowed either the introduction of at least a hand of said user, or of someone not being said user and positioned laterally to said user, or of someone not being said user and positioned at the rear of said user, in that two (111, 112) of said at least three openings (111, 112, 113) provided on said cover (11) are arranged on opposite portions to said frontal opening (114) and are provided in the frontal portion of said cover (11), and in that the third one (113) of said at least three openings (111, 112, 113) is positioned in the rear or upper portion of said cover (11).

2. The device according to claim 1, wherein said third opening (113) of said at least three openings (111, 112, 113) is dimensioned to allow the introduction of two hands.

3. The device according to claim 2, wherein said cover (11), in top view, is provided with a front portion with three sides: a central side on which there is provided the opening (114) for the user head, and two sides, symmetrical to said central side, inclined with respect to the same at an angle between 30° and 60°, on which there are provided said openings (111, 112) for the introduction of the user hands.

4. The device according to claim 2, wherein said cover (11), in top view, is provided with a front portion with a frontal side on which there are provided both the opening (114) for the user head and said openings (111, 112) for the introduction of the user hands.

5. The device according to claim 2, wherein said cover (11), in top view, is provided with an elliptic shape, and in that in the front portion of said ellipse there are provided both the opening (114) for the user head and said openings (111, 112) for the introduction of the user hands.

6. The device according to claim 2, further comprising two stiff arms (152), integral to said cushion, but arranged so that they do not come in contact with the patient head, each provided, at its own end, with a support (153) in soft material, the shape of said stiff arms being such that when the patient head rests on said soft cushion (151) and said supports (153), there remains sufficient place between the patient head and said rigid arms for the introduction of a hand.

7. The device according to claim 1, wherein each of said openings (111, 112, 113) is provided with a protection membrane, in flexible material, such as rubber or silicone, on said protection membrane being provided a notch or slotted hole, which allows the introduction of the hand, allowing the membrane to adhere to the user wrist/forearm.

8. The device according to claim 1, wherein said lower reservoir (10) comprises in the frontal portion, at the opening for the introduction of the head, an insert (15) comprising a cushion (151) for user neck resting and a seal (154) with respect to the edge of the front of the reservoir.

9. The device according to claim 1, further comprising inside the volume enclosed by the lower reservoir (10) and cover (11), at least a shampoo dispenser and/or a conditioner dispenser (119) integral to the same device or removably fastened thereto.

10. The device according to claim 1, wherein said water delivery means (115) can comprise a shower head, integrally fastened, in the inner side, to the upper portion of said cover (11) and configured to deliver water on the user hair.

11. The device according to claim 1, wherein said water delivery means (115) comprise a mobile head shower, connected to a flexible pipe.

12. The device according to claim 1, further comprising a portable container containing a first tank which can be filled with clean water, water thrusting means connected to said feeding means, as well as a second tank for dirty water, connected to said water discharge means.

13. The device according to claim 12, wherein said thrusting means comprise a pump, configured to take from said tank, which can be filled with clean water, and controlled by actuation and adjusting means positioned inside the case formed by lower reservoir (10) and cover (11).

14. The device according to claim 12, wherein said thrusting means comprise an air pump, configured so that the tank, which can be filled with clean water, is brought under pressure.

15. The device according to claim 1, wherein said water discharging means (14) comprise a pump configured to take from the bottom of the lower reservoir (10) and to discharge water through said discharge pipe.

* * * * *